United States Patent [19]

Richilano

[11] 4,173,343

[45] Nov. 6, 1979

[54] MALLET PUTTER

[75] Inventor: Vincent J. Richilano, Lakewood, Ohio

[73] Assignee: Zephyr Industries, Inc., Lakewood, Ohio

[21] Appl. No.: 693,175

[22] Filed: Jun. 7, 1976

[51] Int. Cl.[2] ..... A63B 53/04

[52] U.S. Cl. ..... 273/169; 273/167 A

[58] Field of Search ..... 273/77 R, 80 C, 163 R, 273/164, 167-174

[56] References Cited

U.S. PATENT DOCUMENTS

| | | | |
|---|---|---|---|
| 723,534 | 3/1903 | Knight | 273/167 F |
| 1,064,916 | 6/1913 | Kelly et al. | 273/169 X |
| 1,526,951 | 2/1925 | Beaumont | 273/169 X |
| 1,555,425 | 9/1925 | McKenzie | 273/169 |
| 1,567,248 | 12/1925 | Dahlman | 273/169 |
| 1,652,404 | 12/1927 | Graveure | 273/169 X |
| 1,666,174 | 4/1928 | Holland | 273/169 X |
| 2,414,234 | 1/1947 | Link | 273/169 |
| 3,218,072 | 11/1965 | Burr | 273/167 J X |
| 3,333,854 | 8/1967 | White | 273/164 |
| 3,556,533 | 1/1971 | Hollis | 273/171 |
| 3,567,228 | 3/1971 | Lynn | 273/169 |
| 3,873,094 | 3/1975 | Sebo et al. | 273/169 X |
| 3,966,210 | 6/1976 | Rozmus | 273/169 |

FOREIGN PATENT DOCUMENTS

| | | | |
|---|---|---|---|
| 13531 | of 1909 | United Kingdom | 273/167 F |
| 727051 | 3/1955 | United Kingdom | 273/169 |

OTHER PUBLICATIONS

"Golf Digest"; Nov. 1975; p. 27.

*Primary Examiner*—Richard J. Apley
*Attorney, Agent, or Firm*—Fay & Sharpe

[57] ABSTRACT

The present disclosure relates to an aluminum mallet type putter for golf characterized by having a stainless steel "sweet spot" which is mounted in the face of the mallet so that the sweet spot is of greater length than its diameter and the concentration of weight is increased at the sweet spot to improve directionality of putt and give improved feel for the subsequent correction of one's putting stroke.

This disclosure of a mallet type putter for golf has inset within its striking face at the sweet spot a plug of stainless steel which is $\frac{5}{8}''$ in diameter by $1\frac{5}{8}''$ in depth and provides greater directionality to a golf ball as well as improved flight characteristics.

8 Claims, 4 Drawing Figures

MALLET PUTTER

BRIEF BACKGROUND OF THE INVENTION

In general, all putters for golf are of the blade or mallet type, of which there are approximately 400 different types. Shafts of putters are normally made of aluminum, steel or hickory. Inclination of shafts may be 55°, 65°, 72° or 82° while loft varies from 2½° to 8°. A shaft or its extension may or may not pass through a sweet spot and may be a variety of designs such as a gooseneck style. A heavy core is always utilized in connection with any type of shaft or neck design.

PREFERRED EMBODIMENTS OF THE INVENTION

One object of this invention is to provide a new type of aluminum mallet putter having an improved heavy core of stainless steel or titanium carbide which is inset at the sweet spot of the putter.

A further object of the invention is to provide an improved sole which passes through grass with greater ease.

The foregoing objects of this invention are combined with an improved caliper or position gauge comprising a strip of reflective material or paint which extends the width of a golf ball on the upper face of the mallet facing the putter and over adjacent the putting face and the heavy core of stainless steel to aid a golfer in lining up or calipering his ball and thereby improve accuracy.

Figure 1:
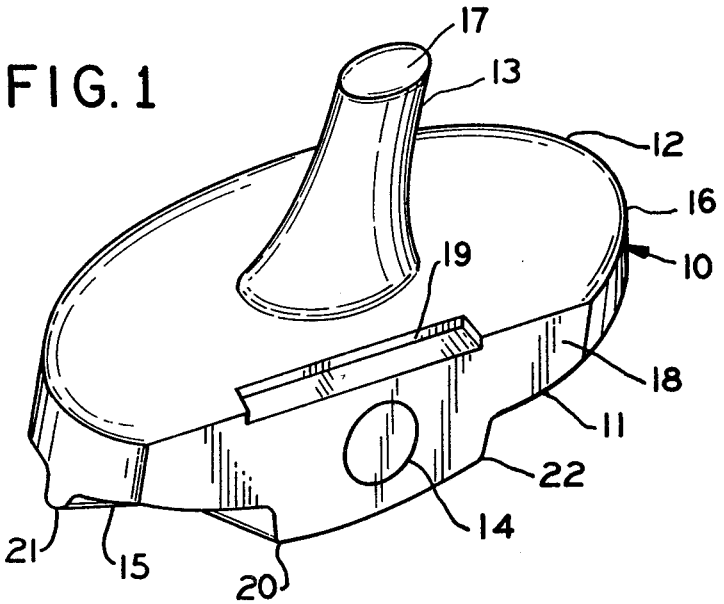
FIG. 1 is a perspective view of the new putter of this invention.
Figure 3:
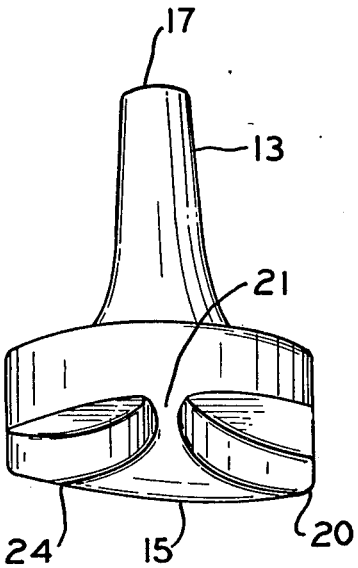
FIG. 3 is a view showing the toe of the putter of this invention.
Figure 2:
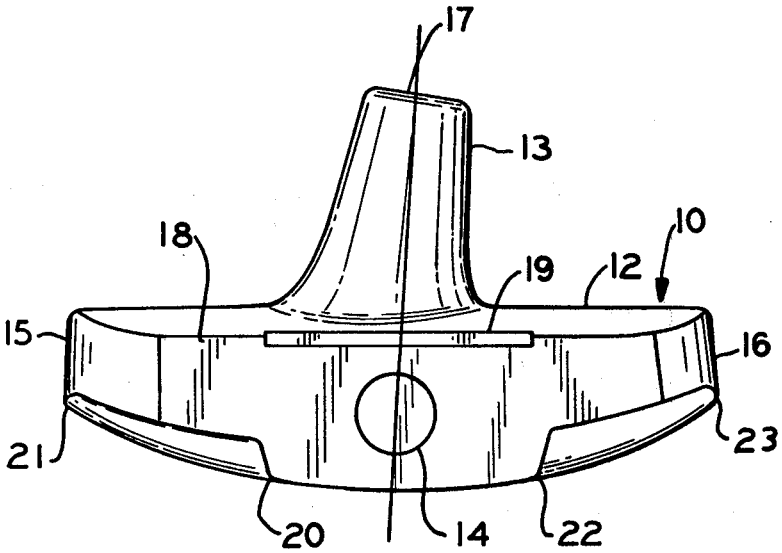
FIG. 2 is a view showing the face of the putter of this invention.
Figure 4:
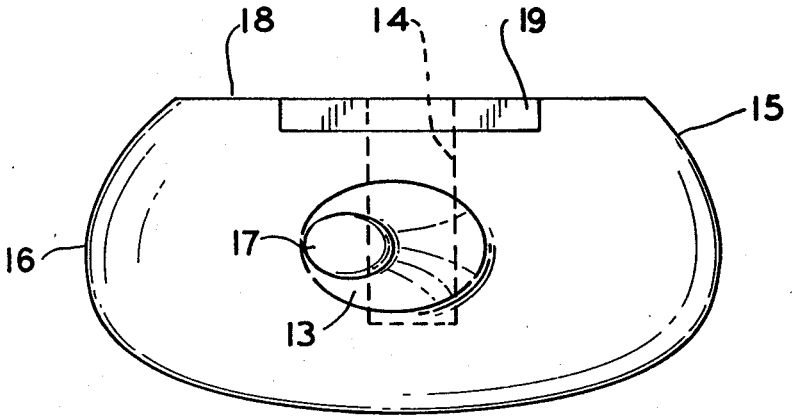
FIG. 4 is a top view of the putter of this invention.

In referring now to the drawings, it will be noted that FIG. 1 is a front view of the face of the putter, generally shown at 10, which in this instance is a mallet type putter, with the sole at 11, the top face at 12, the hosel at 13 and the new type heavy core at 14, the core or sweet spot being made of stainless steel and having a diameter of ⅝" and a depth of 1⅝". The toe of the club is shown at 15 and the heel at 16. A shaft of steel or aluminum is secured within a socket 17 of the hosel 13. An extension of the shaft passes through the sweet spot of the putter. The caliper or position gauge is at 19 and extends along the face of the putter as at 18 for the width of the golf ball, or 1.68". The caliper or position gauge 19 is shown as slightly recessed in the top face 12 and marked in a contrasting color.

The rocker flared sole 11 has a swept back or flared portion immediately below the toe 15 as at 20, and extends from the face 18 rearwardly to the apex of the toe at 21. A similar flared portion is shown beneath the heel at 16. It begins at 22 and ends at 23 at the rearwardmost portion of the heel.

Complimentary swept back portions, indicated generally at 24 and 25, are shown at the trailing edge under the toe and heel respectively, allowing the sole to pass through high grass with minimum resistance and providing concentration of weight at the sweet spot or at dead center. Therefore, when a ball is hit, very little torque is encountered. A diamond shaped sole is produced as a result of this design.

The putter of this invention is designed so as to have improved feel. The sensation is such that it telegraphs misalignment to a golfer who on the next putt is able to change his stroke and correct it so that the ball is not hit off center, which normally produces some torque resulting in a ball not following a true course. Other facts, of course, also may affect a ball after it leaves the putter such as the grain of grass and slope of the green.

The mallet is designed to allow the center of gravity of the putter head to be located rearward from the striking face, which is not the case with a blade putter. As such, this specific design offers greater resistance to rotational forces at impact with the ball. The concentration of greater weight at the sweet spot makes the putter steadier and allows for an equivalent blow off center, i.e. off the sweet spot, by a set amount without as great a torsional force.

In addition with the sweet spot being of stainless steel or titanium carbide, there is a contrast in color on the face because the materials being used are different and there is a concentration of weight at the sweet spot giving what is called greater sectional density and therefore better impetus to the ball when it is struck. By sectional density it is meant that the heavy core is longer than its diameter or width. The length to diameter ratio is 1:2.60. Analagously, hitting a billiard ball with a cue is an example of high sectional density. The putter of this invention weighs between 10½ to 18 ounces.

While there have been described what are at present considered to be the preferred embodiments of this invention, it will be obvious to those skilled in the art that various changes and modifications may be made therein without departing from the invention, and it is therefore the intent of the appended claims to cover all such changes and modifications as may fall within the true spirit and scope of the invention.

What is claimed is:

1. A mallet type putter comprising:

a shaft having a center line extending between opposite ends;

a head secured to one end of said shaft, having a striking face, and being constructed of a metal with a specific gravity less than 3 and a single heavy core with a specific gravity of at least 7 to provide a sweet spot for the head;

said heavy core being at the sweet spot, extending rearwardly from the striking face and having a front and a rear end;

said center line of said shaft passing through the sweet spot for the head and through said core thereby reducing chances of twisting the putter while in the hands of a golfer;

said core having a substantially greater axial length perpendicular to the striking face than width parallel to the striking face;

the center of gravity of the putter head being rearwardly displaced from the striking face;

the front end of said core being on and constituting a part of the striking face of the putter, and said core being rigidly secured within the head, whereby the sectional density of the core provides improved trajectory for a golf ball with reduced wobble.

2. The putter of claim 1 in which the core has a diameter of about ⅝ inches and a length of about 1⅝ inches.

3. The putter of claim 1 in which a position gauge is mounted on the mallet the exact length of a golf ball and positioned evenly on either side of the sweet spot.

4. The putter of claim 1, wherein the ratio of axial length of said core to the width of said core is greater than 2.

5. The putter of claim 1, wherein the metal of said head is aluminum and the rear end of said core is shouldered within the aluminum head.

6. The putter of claim 5, wherein said heavy core is constructed of a material selected from the group consisting of stainless steel and titanium carbide.

7. The putter of claim 5, wherein the ratio of axial length of said core to the width of said core is greater than 2.

8. The putter of claim 1, wherein said head has a diamond shaped sole with apexes respectively at the toe and heel of the head, and flared portions extending from the toe and heel apexes to the striking face and flared portions extending from the apexes at the toe and heel to the trailing edge of the head for reducing the resistance of and increasing the stability of the head moving through grass during putting.

* * * * *